United States Patent [19]

Olsen

[11] Patent Number: 4,688,988

[45] Date of Patent: Aug. 25, 1987

[54] COOLABLE STATOR ASSEMBLY FOR A GAS TURBINE ENGINE

[75] Inventor: Howard Olsen, Wethersfield, Conn.

[73] Assignee: United Technologies Corporation, Hartford, Conn.

[21] Appl. No.: 682,711

[22] Filed: Dec. 17, 1984

[51] Int. Cl.[4] ..... F01D 5/14

[52] U.S. Cl. ..... 415/116

[58] Field of Search ..... 415/115, 116, 117, 180, 415/134, 138; 416/193 A

[56] References Cited

U.S. PATENT DOCUMENTS

| | | | |
|---|---|---|---|
| 2,440,933 | 5/1948 | Cunningham, Jr. | 416/95 |
| 2,915,279 | 12/1959 | Chamberlin | 416/95 |
| 2,991,045 | 7/1961 | Tassoni | 353/14 |
| 3,182,955 | 5/1965 | Hyde | 415/115 |
| 3,186,166 | 6/1965 | Grieb | 415/116 |
| 3,314,650 | 4/1967 | McCormick | 415/114 |
| 3,341,172 | 9/1967 | Rahaim | 415/135 |
| 3,529,906 | 9/1970 | McLaurin et al. | 415/180 |
| 3,572,966 | 3/1971 | Borden et al. | 416/95 |
| 3,661,477 | 5/1972 | Westrum | 417/373 |
| 3,752,598 | 8/1973 | Bowers et al. | 415/173 |
| 3,801,220 | 4/1974 | Beckershoff | 416/193 A |
| 3,834,831 | 9/1974 | Mitchell | 416/95 |
| 3,892,497 | 7/1975 | Gunderlock et al. | 415/134 |
| 3,970,318 | 7/1976 | Tuley | 277/26 |
| 3,975,112 | 8/1976 | Brown et al. | 415/116 |
| 3,981,609 | 9/1976 | Koenig | 415/117 |
| 3,986,789 | 10/1976 | Pask | 415/178 |
| 4,355,952 | 10/1982 | Brown et al. | 415/115 |
| 4,457,668 | 7/1984 | Hallinger | 416/95 |
| 4,485,620 | 12/1984 | Koenig et al. | 415/116 |

FOREIGN PATENT DOCUMENTS

| | | | |
|---|---|---|---|
| 830853 | 11/1949 | Fed. Rep. of Germany | 415/137 |
| 1330656 | 5/1963 | France | 416/193 A |

*Primary Examiner*—Robert E. Garrett
*Assistant Examiner*—John Kwon
*Attorney, Agent, or Firm*—Gene D. Fleischhauer

[57] ABSTRACT

A coolable stator assembly formed of wall segments 36 for bounding a working medium flow path 14 is disclosed. The wall segments extend circumferentially about the working medium flow path and are circumferentially spaced leaving a clearance gap G therebetween. A duct 148 for cooling air is formed by the facing sides 144, 146 of the wall segments and a pair of radially spaced seal elements such as an inner seal plate 134 and an outer air seal plate 136. In one embodiment, a primary flow path for cooling air extends radially outwardly of the wall segments and the working medium flow path extends radially inwardly of the wall segments. The duct is pressurized with cooling air from an adjacent location at an intermediate pressure between the primary flow path 32 and the working medium flow path 14.

10 Claims, 4 Drawing Figures

COOLABLE STATOR ASSEMBLY FOR A GAS TURBINE ENGINE

TECHNICAL FIELD

This invention relates to axial flow rotary machines of the type having a flow path for working medium gases. More particularly, the invention is about a duct for a flow path for cooling air which is near the working medium flow path. Although the invention was conceived during work in the field of axial flow, gas turbine engines, the invention has application to other fields which employ rotary machines.

BACKGROUND ART

An axial flow, gas turbine engine typically has a compression section, a combustion section, and a turbine section. An annular flow path for working medium gases extends axially through these sections of the engine. A stator assembly extends about the annular flow path for confining the working medium gases to the flow path and for directing the working medium gases along the flow path.

As the gases are passed along the flow path, the gases are pressurized in the compression section and burned with fuel in the combustion section to add energy to the gases. The hot, pressurized gases are expanded through the turbine section to produce useful work. A major portion of this work is used as output power, such as for driving a free turbine or developing thrust for an aircraft.

A remaining portion of the work generated by the turbine section is not used for output power. Instead, this portion of the work is used in the compression section of the engine to compress the working medium gases. The engine is provided with a rotor assembly for transferring this work from the turbine section to the compression section. The rotor assembly has arrays of rotor blades in the turbine section for receiving work from the working medium gases. The stator assembly has arrays of stator vanes which extend inwardly across the working medium flow path between the arrays of rotor blades. The stator vanes direct the approaching flow to the rotor blades at a desired angle. The rotor blades have airfoils that extend outwardly across the working medium flow path and that are angled with respect to the approaching flow to receive work from the gases and to drive the rotor assembly about the axis of rotation.

The stator assembly further includes an outer case and arrays of wall segments supported from the outer case which extend circumferentially about the working medium flow path. The wall segments are located adjacent to the working medium flow path for confining the working medium gases to the flow path. These wall segments have radial faces which are circumferentially spaced leaving a clearance gap G therebetween. The clearance gap is provided to accommodate changes in diameter of the array of wall segments in response to operative conditions of the engine as the outer case is heated and expands or is cooled and contracts.

One example of an array of wall segments is the array of stator vanes. Each wall segment of the array of stator vanes bounds the working medium flow path and has one or more of the airfoils which extend inwardly across the working medium flow path. Another example of an array of wall segments is an outer air seal formed of circumferentially adjacent wall segments which extend about an array of rotor blades in close proximity to the airfoils for confining the working medium gases to the flow path.

The wall segments of the outer air seal and stator vanes are in intimate contact with the hot working medium gases and receive heat from the gases. The segments are cooled to keep the temperature of the segments within acceptable limits. One example of such a coolable array of wall segments is shown in U.S. Pat. No. 3,583,824 issued to Smuland et al. entitled "Temperature Controlled Shroud and Shroud Support". Smuland employs an outer air seal which is disposed outwardly of an array of rotor blades. Cooling air is flowed along a primary flow path in a cavity which extends circumferentially about the outer air seal between the outer air seal and the engine case. The cooling air is flowed through an impingement plate to precisely meter and direct the flow of cooling air against the outer surface of the wall segment. The air is gathered in an impingement air cavity and exhausted from the impingement air cavity into the working medium flow path to provide a continuous flow of fluid through the plate and against the wall segment. This cooling air provides convective cooling to the edge region of the outer air seal and to the adjacent structure as it passes through the outer air seal into the working medium flow path.

A seal member is typically provided in modern engines between each pair of circumferentially spaced wall segments. The seal member bridges the gap G between the segments to block the leakage of the cooling air between the segments into the working medium flow path. One example of wall segments showing this feature is in U.S. Pat. No. 3,341,172 issued to Rahaim entitled "Fluid Machine Casing Seal Structure". Rahaim discloses a C-shaped seal member extending between blocks **55*b*, as shown in FIG. 3 and FIG. 6**, to prevent the leakage of cooling air from the exterior of the engine into the working medium flow path.

Another example of an array of wall segments provided with seal members is shown in U.S. Pat. No. 3,752,598 issued to Bowers et al. entitled "Segmented Duct Seal". Bowers et al. shows an array of stator vanes in FIG. 1 and FIG. 2 having circumferentially extending seal members extending between adjacent stator vanes. A primary flow path for cooling air, such as the flow paths 36 and 38, supplies cooling air to the interior of the vanes through openings in the ends of the vanes. The seal member is a seal plate 50 disposed in facing grooves between adjacent segments. The seal plate bridges the gap between the segments to block the leakage of cooling air along a leak path between the segments which extends from the primary flow path to the working medium flow path. These seal plates, though effective in blocking the leakage of working medium gases along the flow path, do not form a leak proof seal. This leakage is acceptable because it provides cooling to portions of the wall segments which are adjacent to the gap G and which are heated by the working medium gases on both a radial face and a circumferential face.

Although the use of cooling air is accepted because it increases the service life of wall segments and airfoils in comparison to uncooled wall segments and uncooled airfoils, the use of cooling air decreases the operating efficiency of the engine. This decrease occurs because a portion of the engine's useful work is used to pressurize the cooling air in the compression section decreasing the amount of useful work available for output power. One way to increase operating efficiency is to decrease the leakage of cooling air from the cooling air flow paths in the engine. Another way to increase operating efficiency is to more effectively use the cooling air so that increased cooling is provided with the same amount of cooling air or so that the same amount of cooling is provided with a decreased amount of cooling air.

Accordingly, scientists and engineers are seeking to more efficiently supply cooling air to components, such as the wall segments, by both improving the sealing structure and by more effectively using the cooling air supplied to the components.

DISCLOSURE OF INVENTION

This invention is predicated in part on the recognition that cooling air which is exhausted into the working medium flow path after it has provided cooling to a wall segment includes an amount of exhausted cooling air which might be diverted from flowing directly into the working medium flow path to another region of the engine if a duct could be created for the air.

According to the present invention, a rotary machine having a working medium flow path includes a pair of circumferentially spaced adjacent wall segments and a pair of seal members which extend axially between the segments to create a duct for flowing cooling air adjacent to the working medium flow path.

This invention is further predicated in part on the recognition that, first, the leakage of cooling air between certain wall segments is directly related to the difference in pressure between a high pressure flow path outwardly of the segments and the working medium gases; and, secondly that the effect of this pressure difference on the leakage of cooling air is reduced by providing a duct between the segments which operates at an intermediate pressure with cooling air delivered from another, lower pressure region of the engine.

In accordance with one embodiment of the present invention, (1) the pair of wall segments separate a working medium flow path from a flow path for high pressure cooling air; and, (2) the duct between the wall segments is pressurized with cooling air exhausted at an intermediate pressure through an adjacent array of wall segments to block a leak path between the segments which extends from the flow path for cooling air to the working medium flow path.

In accordance with one embodiment of the present invention, the duct is formed by circumferentially facing sides of the wall segments and a pair of radially spaced seal plates that extend along the entire axial length of the sides of the wall segments.

A primary feature of the present invention is an array of circumferentially extending wall segments. Each wall segment is spaced circumferentially from an adjacent seal segment leaving a clearance gap G therebetween. Another feature is a pair of axially and circumferentially extending seal members which are disposed in the gap G and which are radially spaced to form a duct for cooling air which extends from one end of the seal segment to the other. In one embodiment, the adjacent pair of seal segments have facing sides adapted by an inner pair of grooves and an outer pair of grooves to receive seal plates which extend from one end of the wall segment to the other. In one embodiment, a secondary flow path for cooling air extends radially inwardly to the working medium flow path and is in flow communication with the duct to pressurize the duct. The circumferential gap G between the adjacent wall segments is in flow communication with a primary flow path for cooling air which is radially outwardly of the duct.

A primary advantage of the present invention is the engine efficiency which results from effectively using the cooling air by providing a duct for a cooling air flow path which is adjacent to the working medium flow path. Another advantage is the engine efficiency which results from effectively using cooling air by diverting a portion of the cooling air from a flow path which leads to the working medium flow path to a flow path which uses the cooling air for cooling at a another location before it enters the working medium flow path. Still another advantage of the present invention is the engine efficiency which results from pressurizing a duct with cooling air flowed through an adjacent array of wall segments toward the working medium flow path. The duct blocks a leak path between the pair of segments which extends from a high pressure flow path for cooling air into the working medium flow path.

The foregoing features and advantages of the present invention will become more apparent in light of the following detailed description of the best mode for carrying out the invention and in the accompanying drawings.

BEST MODE FOR CARRYING OUT THE INVENTION

Figure 1:
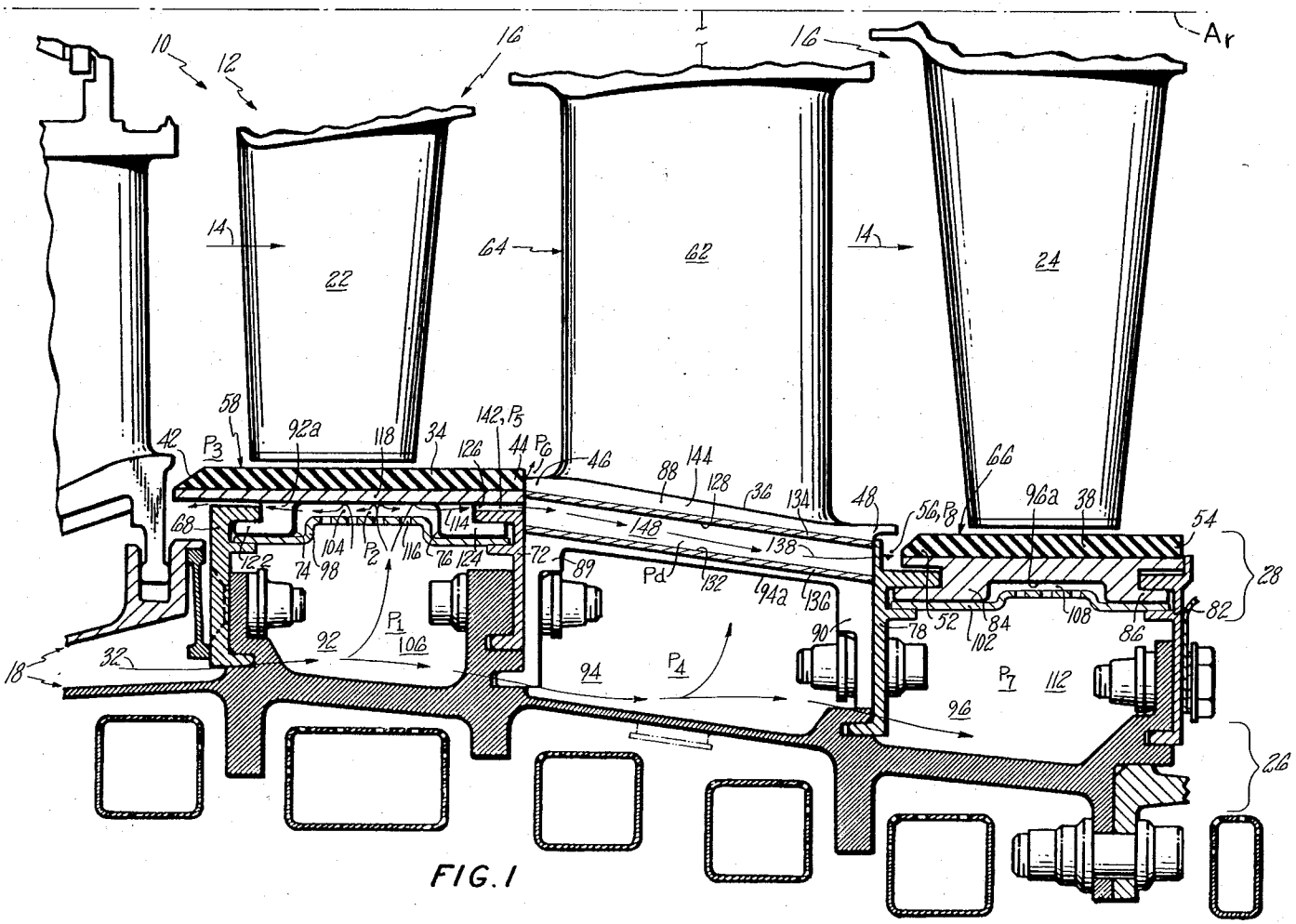
FIG. 1 is a side elevation view of an axial flow gas turbine engine which shows a portion of the turbine section 12 and an axis of rotation $A_r$ of the engine.

FIG. 1 is a side elevation view of an axial flow gas turbine engine 10 which shows a portion of a turbine section 12 and an axis of rotation $A_r$ of the engine. The turbine section includes an annular flow path 14 for working medium gases which is disposed about the axis of rotation. A rotor assembly 16 extends axially through the engine about the axis of rotation. A stator assembly 18 extends axially through the engine about the rotor assembly.

In the turbine section, the rotor assembly includes arrays of rotor blades as represented by the single rotor blade 22 and the single rotor blade 24. The rotor blades extend outwardly across the working medium flow path. The stator assembly includes an engine case 26 which extends circumferentially about the working medium flow path and a wall 28 which is spaced inwardly from the engine case. At least one primary flow path for cooling air, as represented by the flow path 32, extends axially through the engine between the wall 28 and the engine case 26.

The wall 28 extends circumferentially about the working medium flow path in close proximity to the rotor blades 22 and the rotor blades 24 to outwardly bound the working medium flow path. The wall includes three arrays of arcuate wall segments as represented by the single wall segment 34, the single wall segment 36 and the single wall segment 38. The arrays of wall segments are axially adjacent to each other and have ends which are in close proximity to an associated end on the adjacent array of segments. The first array of wall segments 34 has an upstream end 42 and a downstream end 44. The second array of wall segments 36 has an upstream end 46 and a downstream end 48. The third array of wall segments has an upstream end 52 and a downstream end 54. The downstream end 44 of the first array of segments is adjacent to the upstream end 46 of the second array of segments. The downstream end 48 of the second array of segments is spaced axially from the upstream end 52 of the third array of segments leaving a circumferentially extending cavity 56 therebetween.

The first array of wall segments 34 forms an outer air seal 58 which extends circumferentially about the rotor blades 22. The second array of wall segments 36 has one or more airfoils 62 on each segment which extend inwardly across the working medium flow path to form an array of stator vanes 64. The third array of wall segments 38 forms an outer air seal 66 which extends circumferentially about the rotor blades 24.

The coolable stator assembly includes means for supporting each of these arrays of wall segments from the outer case. The means for supporting the outer air seal 58 includes an upstream support 68 and a downstream support 72. The supports are attached to the engine case 26 to support and position the outer air seal in the radial direction about the rotor blades. The supports extend inwardly from the engine case to the upstream end 42 and the downstream end 44 of the wall segments 34. Each wall segment is adapted by an upstream hook 74 and a downstream hook 76 to the engage the supports. The outer air seal 66 is supported the same way from the engine case with an upstream support 78, a downstream support 82 and hooks 84, 86. Each wall segment 36 of the second array of stator vanes has a platform 88 which carries one or more airfoils 62. An upstream support 89 and a downstream support 90 are attached to the platform and extend outwardly from the platform to engage the engine case for support.

The outer air seal 58, the array of stator vanes 64 and the outer air seal 66 are respectively spaced inwardly from the outer case leaving cavities 92, 94 and 96 therebetween. Each wall segment is adapted by an outwardly facing surface 92*a*, 94, 94*a*, and 96*a* to bound these cavities. Circumferentially extending impingement plates, such as the impingement plate 98 and the impingement plate 102, are spaced outwardly from the outer air seal 58 and the outer air seal 66 and inwardly from the engine case. The impingement plate 98 divides the cavity 92 into an inner cavity 104 and an outer cavity 106. The impingement plate 102 divides the cavity 96 the same way into an inner cavity 108 and an outer cavity 112.

The primary (first) flow path 32 for cooling air extends axially through the engine and outwardly of the working medium flow path 14 through openings (not shown) into the outer cavity 106. The flow path extends from the outer cavity 106 into the cavity 94 through openings in the supports 72, 89 and the case 26 (not shown), and thence to the outer cavity 112 through openings (not shown) in the supports 90, 78 and the case. Alternatively, cooling air may be provided along a second primary flow path extending through the case 26 of the engine to cavity 94 and then to cavity 96. In the outer cavity 106, the primary flow path 32 extends radially inwardly to the impingement plate 98. A second flow path, such as the secondary flow path 114 for cooling air, extends axially and circumferentially in the inner cavity 104 outwardly of the outer air seal 58. A plurality of impingement holes 116 in the impingement plate places the primary flow path in flow communication with the secondary flow path. The impingement holes are sized to meter the flow of cooling air from the outer cavity and direct the flow of cooling air against the outer air seal. Each wall segment includes a circumferentially extending substrate 118 from which the upstream hook 74 and the downstream hook 76 extend. Each of these hooks has slots, such as the slots 122 in the upstream hook and the slots 124 in the downstream hook, for venting the inner cavity 104 outwardly of the outer air seal. As shown, the secondary flow path impinges against the outer surface 92*a* of the outer air seal, flows rearwardly through the segments through the slots 124 in the downstream hook of the outer air seal to a first point 126, and thence between the adjacent substrates 118 and between substrates and the stator vanes into the working medium flow path 14.

Each wall segment 36 of the adjacent array of wall segments which form the array of stator vanes 64 has an inner groove 128 and an outer groove 132. These grooves adapt the wall segment to receive inner and outer seal members, such as an inner seal plate 134 and an outer seal plate 136 which are shown in cross section. A third flow path 138 for cooling air extends axially rearwardly between the adjacent stator vane wall segments and between the seal plates from the upstream end 46 to the downstream end 48 of the stator vane, and thence in gas communication with the cavity 56 between the stator vanes and the outer air seal 66. The third flow path for cooling air is in gas communication with the second flow path at a point 142 on the second flow path which is between the first point 126 and the working medium flow path.

Figure 2:
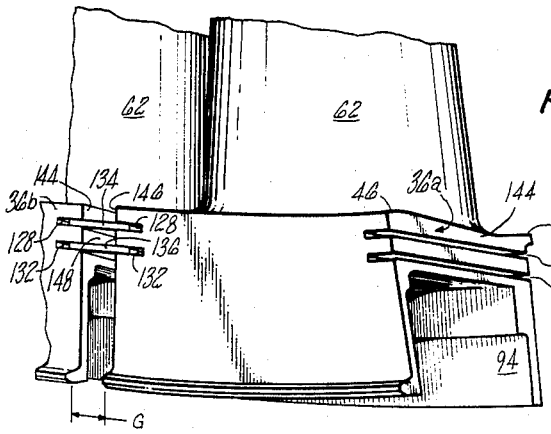
FIG. 2 is a partial perspective view of two adjacent wall segments with portions of the wall segments broken away for clarity.

FIG. 2 is a partial perspective view of a pair of adjacent wall segments 36 (that is, 36*a* and 36*b* with portions of the wall segments broken away b) clarity. Each wall segment has a first side 144 which faces in a first circumferential direction and a second side 146 which faces in a second, opposite circumferential direction. Each first side of the pair of segments faces the second side of the adjacent segment. These sides are circumferentially spaced leaving a gap G therebetween. Each side has an inner groove 128 which extends from the upstream (first) end 46 to the downstream (second) end 48 of the segment and which faces the inner groove 128 in the facing side of the other segment. Each side has an outer groove 132 which is spaced radially outwardly from the inner groove, which extends from the upstream end of the segment to the downstream end of the segment and which faces the outer groove in the facing side of the other segment. The inner seal plate 134 is disposed in the inner grooves and extends circumferentially across the gap G and axially from the first end to the second end. The outer seal plate 136 is similarly disposed in the outer grooves and extends circumferentially across the gap G and axially from the first end of the segment to the second end of the segment. The two seal plates and the sides of the segments which extend between the grooves define a duct 148 for cooling air which is in gas communication with the secondary flow path 114.

Figure 3:
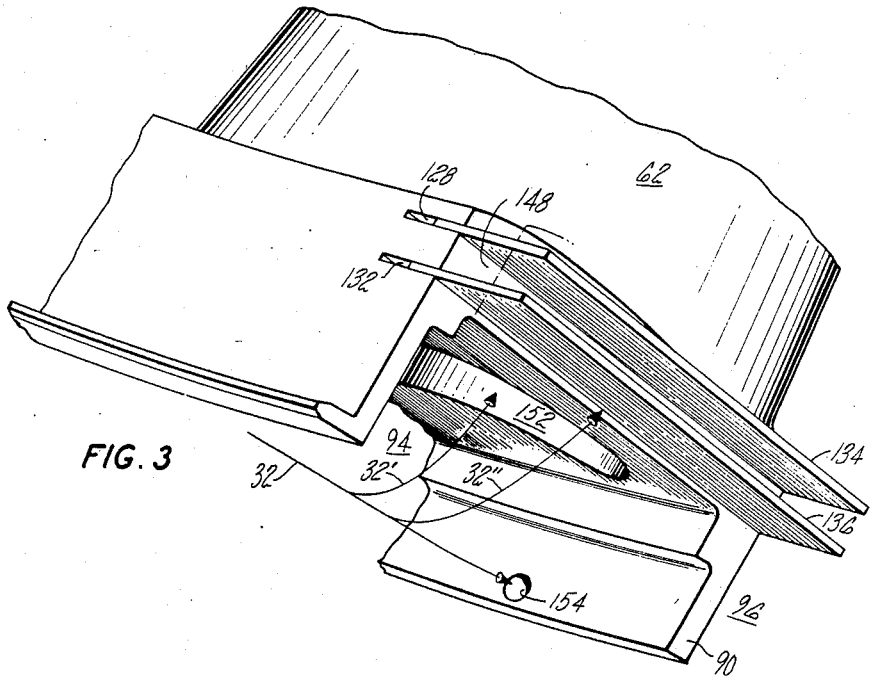
FIG. 3 is a partial perspective view of one wall segment of an array of wall segments which is broken away to show a pair of axially extending seal plates which slidably engage the wall segment.

FIG. 3 is a partial perspective view of the wall segment 36 of the array of stator vanes 64. Each stator vane has an opening 152 at each airfoil which places the interior of the airfoil in flow communication with the primary flow path 32 for cooling air. The primary flow path extends axially into the cavity 94 beneath the stator vane, and thence through the opening 154 in the downstream support 90 into the cavity 96 outwardly of the second outer air seal 66. A portion of the cooling air from the primary flow path is flowed along the primary flow path 32' for cooling air into the opening 152 in the airfoil. Another portion of cooling air from the primary flow path flows along a leak path, 32'' which extends from the primary flow path to the working medium flow path. This flow path is interrupted by the inner seal plate 134, the outer seal plate 136, and the pressurized air in the duct 148.

Figure 4:
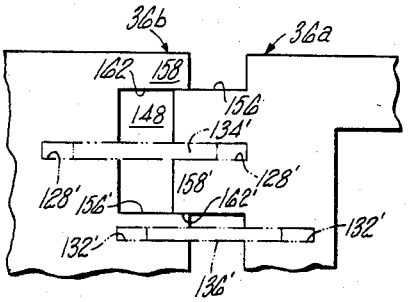
FIG. 4 is a view taken along the lines 4—4 of FIG. 1 showing an alternate embodiment employing a seal member which is integral with one of the wall segments.

FIG. 4 is a cross-sectional view of the duct region of a wall segment of the type shown in FIG. 3 showing an alternate embodiment in which the duct 148 is formed by overlapping shoulders on the adjacent sides of the seal segments. In the embodiment shown, the first wall segment **36*a* has an axially extending shoulder having a surface 156 which faces inwardly toward the working medium flow path. One of the seal members, such as the projection 158, is integral with the second wall segment 36*b* and has an outwardly facing surface 162 that overlaps the surface on the shoulder of the first seal segment. This construction might be used with a second shoulder and second projection construction 156', 158', 162' or with a seal plate 134' as shown by the seal plate in phantom. Alternatively, both of these shoulders and projections might be provided to the adjacent wall segments in combination with a single seal plate 134' or with a pair of radially facing seal plates as shown by the seal plate 134' and the seal plate 136'** in phantom.

During operation of the gas turbine engine 10, cooling air is flowed along the primary flow path 32 and hot working medium gases are flowed along the annular flow path 14 into the turbine section 12 of the engine. Components of the turbine section are heated by heat received from the working medium gases and cooled by the transfer of heat to the cooling air. These components include: the engine case 26; the wall segments of the outer air seal 58, the wall segments of the array of stator vanes 64, the wall segment of the outer air seal 66; and, the supports for these wall segments, that is, supports 68, 72, 89, 90, 78, 82.

Cooling air is flowed along the primary flow path 32 into the outer cavity 106, thence to the cavity 94 outwardly of the stator vanes, and thence to the outer cavity 112 outwardly of the outer air seal 66. As a result of the flow of cooling air and the flow of hot working medium gases, relative pressure differences exist between the primary flow path for cooling air and the flow path for working medium gases. These pressure differences in part depend on changes in the level of pressure along the annular flow path 14 and changes in the level of pressure caused by flow losses and by the diversion of a portion of the cooling air from the primary flow path for cooling air 32 to secondary flow paths such as the flow path 114. Pressures at various locations are shown in FIG. 1 and include:

$P_1$, the pressure in the outer cavity 106;

$P_2$, the pressure in the inner cavity 104;

$P_5$, the pressure along the secondary flow path 114 in the region between the first and second points 126, 142;

$P_4$, the pressure in the cavity 94 outwardly of the stator vanes; and, $P_7$, the pressure in the outer cavity 112 outwardly of the outer air seal 66.

Pressures at various locations along the annular flow path include the following:

$P_3$, the pressure at the upstream end 42 of the first array of wall segments;

$P_6$, the pressure adjacent the downstream end 44 of the first array of wall segments and the upstream end 46 of the second array of wall segments at the location where the secondary flow path 114 enters the working medium flow path; and, $P_8$, the pressure in the cavity 56 between the downstream end 48 of the second array of wall segments and the upstream end 52 of the third array of wall segments.

The relative magnitudes of the pressures are as follows:

$P_1$ is slightly greater than $P_2$, $P_2$ is greater than $P_3$, $P_3$ is greater than $P_4$, $P_4$ is greater than $P_5$, $P_5$ is greater than $P_6$, $P_6$ is greater than $P_7$, and $P_7$ is greater than $P_8$.

During operation, the difference in pressure between the duct and the working medium flow path urges the inner seal plate 134 inwardly against the seal segments and the difference in pressure between the primary flow path 32 and the duct urges the outer seal plate 136 inwardly against the seal segments into sealing contact with the segments. As cooling air is flowed along the flow path 32 into cavity 94, the pressure difference between the pressure $P_4$ of the cavity and the pressure $P_d$ of the duct causes a leak path 32' to form which extends from the primary flow path into the duct 148. The duct is pressurized by cooling air flowed along the secondary flow path 114 from the second point 142, the secondary flow path being approximately at a pressure $P_5$ and being in gas communication with the duct. This cooling air pressurizes the duct and reduces the leakage from the primary flow path 32 in the cavity 94 in comparison with constructions where the pressure difference between the cavity 94 and the working medium flow path is uninterrupted by an intermediate pressure. A further benefit is realized because cooling air for the duct is supplied by cooling air from point 142 ($P_5$) which was exhausted through the wall segments 34 along the secondary flow path 114. Because the secondary flow path contains excess cooling air which would otherwise be wasted in the working medium flow path, pressurizing the duct does not cause a penalty in performance of the engine. An additional benefit occurs because the cooling air that is flowed through the duct 148 cools the sides of the stator vanes in the critical location adjacent to the flow path and is discharged into the cavity 56. This cooling air provides further cooling to components in flow communication with the cavity 56 such as the upstream end 52 of the third array of wall segments. In a sense, the cooling air from the secondary flow path 114 is used three times: once to cool the outer air seal 58; twice, when it is used to pressurize the duct 148 to reduce the leakage from the primary flow path for cooling air in cavity 94; and, finally, a third time when the cooling air is flowed through the duct and discharged from the duct to provide cooling to the stator vanes and to the upstream end of the cavity 56.

An additional advantage occurs during assembly by using grooves for the seal plates, such as an inner groove 128 and an outer groove 132, which extend from the upstream end 46 to the downstream end of the wall segments. The grooves are simply fabricated by grinding a seal groove from one end of the segment to the other without concern for sealing the end of the grooves. In addition, each seal plate may be easily installed from the rear of the array of stator vanes after the stator vanes have been installed in the engine case. This facilitates assembly and inspection by enabling visual inspection of the end of the seal grooves to see if all the seal plates are in place. After assembly is complete, the seal plates are trapped in the axial direction by the downstream support 72 and the first array of wall segments and in the axial downstream direction by the upstream support 78 for the outer air seal 66. Tolerance variations will enable leakage of cooling air into the cavity 56 at the downsteam end of the array of stator vanes. Alternatively, cooling air holes in flow communication with the duct 148, might be supplied through the downstream support.

Although the invention has been shown and described with respect to detailed embodiments thereof, it should be understood by those skilled in the art that various changes in form and detail thereof may be made without departing from the spirit and the scope of the claimed invention.

What is claimed is:

1. In a rotary machine of the type having an axially extending annular flow path for working medium gases, an axially extending flow path for cooling air and an array of circumferentially adjacent wall segments bounding the working medium flow path which includes a pair of circumferentially adjacent wall segments having facing sides which are free to move axially, radially and circumferentially with respect to each other and which are spaced circumferentially one from the other leaving a gap G therebetween which varies under operative conditions of the engine, an improved stator assembly wherein the improvement comprises:

a coolable stator assembly having a pair of seal members which are radially spaced one from the other and which extend axially and circumferentially between the sides of the pair of wall segments and across the gap G, each seal member projecting circumferentially beyond and being free to move circumferentially with respect to one of said wall segments of said pair of adjacent wall segments;

wherein the seal members and the facing sides of the wall segments form a duct for the cooling air flow path, the duct being bounded by the seal members in the radially outward direction and the radially inward direction and bounded by the sides of the wall segments in either circumferential direction.

2. The stator assembly of claim 1 wherein at least one of the seal members of the pair of seal members is a seal plate, wherein each facing side of the pair of wall segments has a groove which faces the groove in the other segment and which adapts the segment to receive the seal plate and wherein said seal plate extends into the grooves and is radially trapped by the grooves.

3. The stator assembly of claim 1 wherein the pair of arcuate wall segments includes a first wall segment and a second wall segment, wherein the first wall segment has an axially extending shoulder having a surface which faces inwardly and wherein one of said seal members is integral with the second wall segment and forms a projection on the segment which has an outwardly facing surface that overlaps the surface on the shoulder of the first seal segment.

4. The stator assembly of claim 2 wherein the pair of arcuate wall segments is formed by a first wall segment and a second wall segment, wherein the first wall segment has an axially extending shoulder having a surface which faces inwardly and wherein the other seal member of said pair of seal members is integral with the second wall segment and forms a projection on the segment which has an outwardly facing surface that overlaps the surface on the shoulder of the first seal segment.

5. The stator assembly of claim 2 wherein said arcuate wall segments each have an airfoil which extends inwardly across the working medium flow path for directing the working medium gases.

6. The stator assembly of claim 3 wherein said arcuate wall segments each have an airfoil which extends inwardly across the working medium flow path for directing the working medium gases.

7. In a rotary machine of the type having an annular flow path for working medium gases, a first flow path for cooling air outwardly of the flow path for working medium gases, a stator assembly including a first array of circumferentially extending segments which outwardly bound the working medium flow path and which have a second flow path for cooling air which extends radially inwardly through the segments to a first point and flowing from the first point to the working medium flow path, and including a second array of circumferentially extending wall segments which outwardly bound the working medium flow path and inwardly bound the first flow path for cooling air, the wall segments defining an outwardly facing circumferentially extending cavity through which the first flow path for cooling air extends, the second array of wall segments having a pair of circumferentially adjacent wall segments having facing sides spaced circumferentially one from the other leaving a gap G therebetween which varies under operative conditions of the engine and through which a leak path extends from the first flow path to the working medium flow path, an improved stator assembly wherein the improvement comprises:

a coolable stator assembly having a pair of seal members which are radially spaced one from the other and which extend axially and circumferentially between the sides of the pair of wall segments and across the gap G to block the flow of cooling air along the leak path;

wherein the seal members and the facing sides of the wall segments form a duct for a cooling air flow path, the duct being bounded by the seal members in the radially outward direction and the radially inward direction, being bounded by the sides of the wall segments in either circumferential direction and being in flow communication with the second flow path for cooling air at a point on the flow path which is between the first point and the working medium flow path to pressurize the duct under operative conditions of the engine with cooling air from the second flow path.

8. For an axial flow rotary machine having an annular flow path for working medium gases and at least one primary flow path for cooling air radially outward of the working medium flow path, a coolable stator assembly, which comprises:

a first array of wall segments extending circumferentially about the working medium flow path to bound the working medium flow path and extending inwardly of one of said primary flow paths for cooling air, the segments having a first end, a second end spaced axially from the first end and a secondary flow path for cooling air which is in gas communication with the primary flow path and which extends radially inwardly past the second end of the segments into the working medium flow path;

a second array of wall segments extending circumferentially about the working medium flow path to bound the working medium flow path and inwardly of one of said primary flow paths for cooling air to bound the primary flow path for cooling air, the segments having a first end which is axially adjacent to the second end of the first array of segments and including at least one pair of segments having sides which are facing and which are circumferentially spaced leaving a gap G therebetween, causing a leak path for cooling air between the segments which extends from the primary flow path for cooling air, the pair of segments further including an inner groove in the side of each segment which extends from the first end of the segment to the second end of the segment and which faces the groove in the other segment, and, an outer groove in the side of each segment which is spaced radially outwardly from the inner groove and which extends from the first end to the second end of the segment and which faces the outer groove in the other segment; and, an inner seal plate which is disposed in the inner grooves, which extends circumferentially across the gap G and which extends axially from the first end to the second end of the segments;

an outer seal plate which is disposed in the outer grooves, which extends circumferentially across the gap G and which extends axially from the first end to the second end of the segments;

wherein the inner seal plate, the outer seal plate and the sides of the pair of segments between the seal plates define a duct for cooling air which is in gas communication with said secondary flow path for cooling air to enable the diversion of a portion of the cooling air from the secondary flow path to the duct to pressurize the duct and block the flow of cooling air along the leak path for cooling air between the pair of segments that extends from the primary flow path to the working medium flow path.

9. The coolable stator assembly of claim 8 wherein the first array of wall segments is an array of arcuate seal segments and the second array of wall segments is an array of stator vanes.

10. The coolable stator assembly of claim 9 which further includes a third array of wall segments having an end spaced axially from the second end of the second array of wall segments leaving a cavity therebetween and wherein the duct is in gas communication with the cavity of the third array of segments before the cooling air reaches the working medium flow path.

* * * * *